US007624739B2

(12) United States Patent
Snaidr et al.

(10) Patent No.: US 7,624,739 B2
(45) **Date of Patent: *Dec. 1, 2009**

(54) TUBULAR CIGARETTE DEVICE COMPRISING CERIUM OXIDE

(75) Inventors: Stanislav M. Snaidr, Mississauga (CA); Larry Bowen, Orangeville (CA); Warren A. Brackmann, Collins, MO (US)

(73) Assignee: Rothmans, Benson & Hedges Inc., North York, Ontario (CA)

( * ) Notice: Subject to any disclaimer, the term of this patent is extended or adjusted under 35 U.S.C. 154(b) by 0 days.

This patent is subject to a terminal disclaimer.

(21) Appl. No.: 11/269,701

(22) Filed: Nov. 9, 2005

(65) Prior Publication Data

US 2006/0060210 A1 Mar. 23, 2006

Related U.S. Application Data

(60) Continuation of application No. 10/796,998, filed on Mar. 11, 2004, which is a continuation of application No. 10/075,378, filed on Feb. 15, 2002, now Pat. No. 6,748,955, which is a division of application No. 09/284,633, filed as application No. PCT/CA97/00762 on Oct. 15, 1997, now Pat. No. 6,371,127.

(60) Provisional application No. 60/037,562, filed on Feb. 11, 1997.

(30) Foreign Application Priority Data

Oct. 15, 1996 (GB) ..... 9621466.3

(51) Int. Cl.
*A24D 3/12* (2006.01)

(52) U.S. Cl. ..... 131/187

(58) Field of Classification Search ..... 131/365, 131/360, 349, 139

See application file for complete search history.

(56) References Cited

U.S. PATENT DOCUMENTS

| | | | |
|---|---|---|---|
| 2,499,733 | A | 3/1950 | Di Rubbio |
| 2,541,837 | A | 1/1951 | Schroff |
| 3,220,418 | A | 11/1965 | Cohn |
| 3,250,280 | A | 5/1966 | Hu |
| 3,502,087 | A | 3/1970 | Romano |
| 3,916,916 | A | 11/1975 | Bramucci |
| 3,991,773 | A | 11/1976 | Walker |

(Continued)

FOREIGN PATENT DOCUMENTS

| | | |
|---|---|---|
| FR | 1583284 | 10/1969 |

(Continued)

OTHER PUBLICATIONS

PCT/CA97/00762 International Search Report dated Apr. 2, 1998.

*Primary Examiner*—Carlos Lopez
(74) *Attorney, Agent, or Firm*—Banner & Witcoff Ltd.

(57) ABSTRACT

A device for minimizing cigarette sidestream smoke and reducing free-burn rate of a burning cigarette is disclosed. The device comprises a non-combustible tubular element encasing an effective length of a tobacco charge of a cigarette located in the tubular element. The tubular element minimizes sidestream smoke emission from a burning tobacco charge and reduces free-burn rate of such burning tobacco charge to increase the number of puffs from the burning tobacco charge.

4 Claims, 9 Drawing Sheets

U.S. PATENT DOCUMENTS

| | | | | |
|---|---|---|---|---|
| 4,585,014 | A | 4/1986 | Fry | |
| 4,685,477 | A * | 8/1987 | Valdez | 131/175 |
| 4,852,590 | A | 8/1989 | Ferka | |
| 4,915,117 | A | 4/1990 | Ito | |
| 5,040,551 | A * | 8/1991 | Schlatter et al. | 131/359 |
| 5,105,838 | A | 4/1992 | White | |
| 5,278,113 | A * | 1/1994 | Ono et al. | 502/66 |
| 5,592,955 | A | 1/1997 | Keritsis | |
| 6,286,516 | B1 * | 9/2001 | Bowen et al. | 131/365 |
| 6,371,127 | B1 | 4/2002 | Snaidr et al. | |

FOREIGN PATENT DOCUMENTS

| | | |
|---|---|---|
| GB | 928 089 | 6/1963 |
| WO | WO 95 34226 | 12/1995 |
| WO | WO 96/22031 | 7/1996 |

* cited by examiner

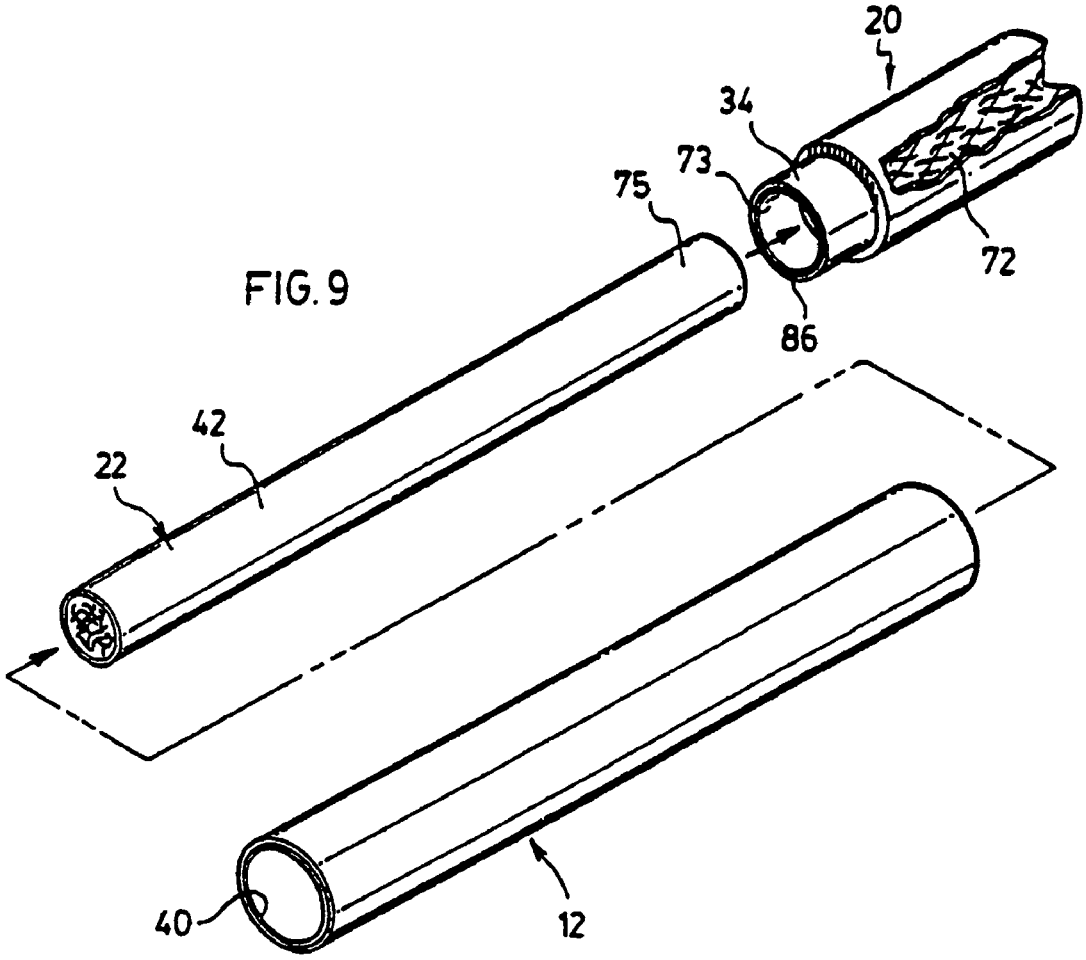
FIG. 9
FIG. 10
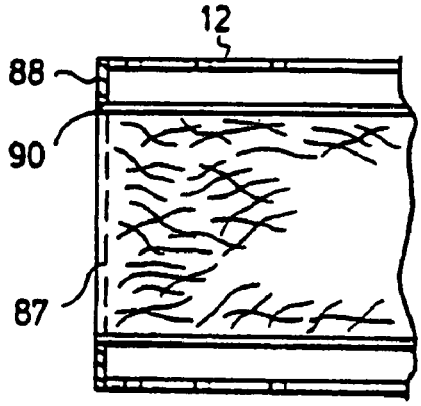
FIG. 11
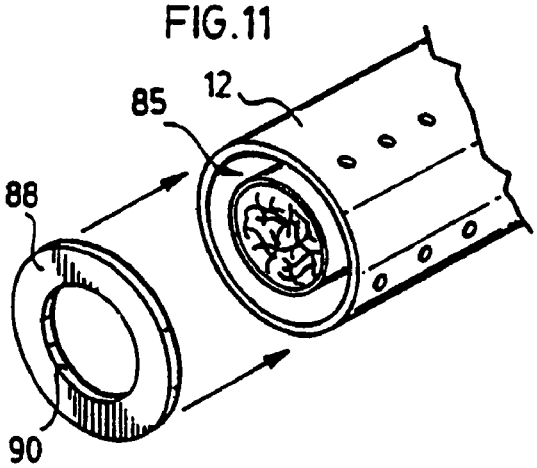

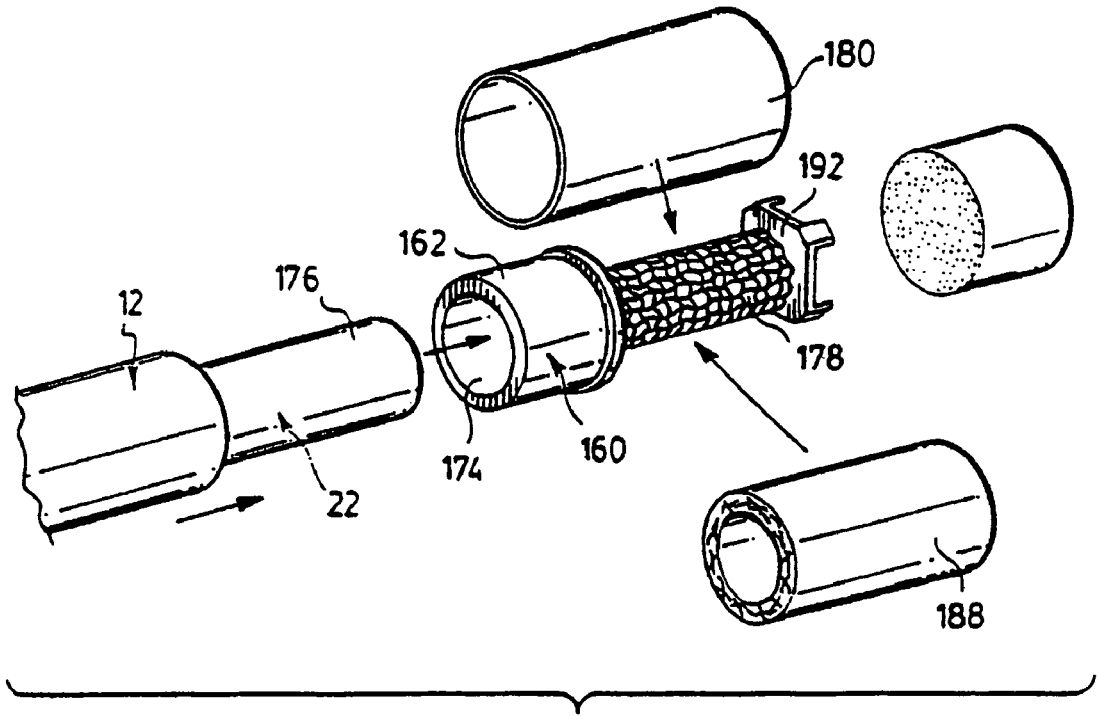
FIG.23
FIG.24
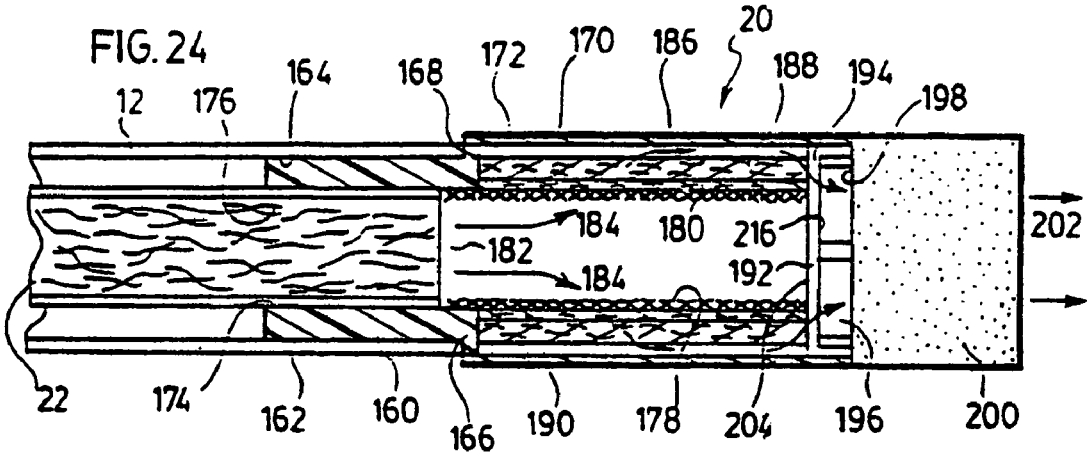

TUBULAR CIGARETTE DEVICE COMPRISING CERIUM OXIDE

RELATED APPLICATIONS

This application is a continuation of U.S. Ser. No. 10/796,998, filed Mar. 11, 2004, which is a continuation of U.S. Ser. No. 10/075,378 filed Feb. 15, 2002, now U.S. Pat. No. 6,748,955, issued Jun. 14, 2004, which is a divisional of U.S. Ser. No. 09/284,633, filed Apr. 15, 1999, which is a 371 application of PCT/CA97/00762 filed Oct. 15, 1997 and published under PCT Article 21(2) in English. The applications are hereby incorporated herein by reference in their entireties.

SCOPE OF THE INVENTION

The invention relates generally to an apparatus which is to be used in combination with a cigarette or other tobacco product to control sidestream smoke and increase the number of puffs available to the smoker from a given amount of tobacco. The apparatus will permit, for instance, using only as much tobacco as necessary to deliver in a much thinner cigarette of lesser diameter, an increased yield of mainstream smoke from the burning tobacco and conventional taste while significantly reducing sidestream smoke. Unlike a conventional cigarette which involves considerable tobacco waste as the thicker cigarette is burned to produce sidestream smoke, the use of the thinner cigarette with this apparatus converts what would be normally tobacco wasted on sidestream smoke into mainstream smoke.

Simply stated, the apparatus includes a tube having a predetermined porosity into which a tobacco product, such as a cigarette is inserted. Preferably, there is a space between the outside of the cigarette and the inside of the tube. The porosity of the tube is carefully selected to achieve sidestream smoke reduction and reduction of free-burn rate between puffs. A very thin cigarette may be inserted and smoked for the same number of puffs as a conventional cigarette, with the resultant saving of tobacco and other cigarette materials and a significant reduction of sidestream smoke. The tube may include a catalytic material to treat sidestream smoke constituents.

The apparatus will be discussed in greater detail and can be used in various different ways, for instance, rather than a cigarette, a tobacco charge that cannot be separately smoked, is inserted and, by controlling the holes and porosity of the tube, could be smoked. It is apparent that all the conventional quality requirements in making a cigarette, such as, firmness and end fallout are no longer of priority with this invention.

While the apparatus could be sized for use with a conventional cigarette, an advantage is that a thin cigarette can be inserted and smoked with the same smoking characteristics as if it were a conventional sized cigarette.

BACKGROUND OF THE INVENTION

When smoking in a conventional manner, there is generally understood to be three types of cigarette smoke, mainstream smoke, exhaled smoke and sidestream smoke. There has been significant interest in reducing the amount of sidestream smoke emitted by a burning cigarette or cigar because it accounts for the majority of smoke emitted during the smoking process. Attempts have been made to control sidestream smoke by one or more of the following techniques:

1) alter the tobacco composition and packing characteristics of the tobacco rod or charge in the cigarette or cigar;
2) alter the wrapping for the cigarette or cigar;

3) alter the diameter of the cigarette as well as its tobacco composition; and/or
4) provide a device on the cigarette or cigar to contain and/or control sidestream smoke emissions.

Various cigarette tobacco and cigarette paper formulations have been suggested which in one way or another affect the free-burn rate of the cigarette or cigar with a view to reducing sidestream smoke and/or achieving an extinguishment of the lit cigarette or cigar when left idle over an extended period of time. Such designs include a judicious selection of tobacco blends, density and multiple layers of cigarette tobacco in the tobacco charge. Such selected designs can appreciably retard the free-burn rate of the cigarette and hence, increase the number of puffs obtained per unit length of cigarette. Either in combination with tobacco selection and/or construction or independently of the tobacco make up, various cigarette paper compositions can also affect free-burn rate of the cigarette. Such paper compositions include the use of chemicals to retard free-burn rate, multiple wrappings of different types of cigarette paper of the same or different characteristics and reduction of air permeability. See for example, Canadian Patent 1,259,008 and U.S. Pat. Nos. 4,878,507 and 4,915,117.

Various devices have been provided which contain the cigarette, primarily for purposes of preventing accidental fires. They may or may not at the same time include various types of filters to filter and thereby reduce the amount of sidestream smoke. Examples of such devices are shown in U.S. Pat. Nos. 1,211,071; 3,827,444 and 4,685,477.

Further, various types of cigarette holders have been made available which service the primary feature of minimizing staining of the smoker's fingers. Such devices may be connected to the cigarette tip and/or mounted on the cigarette, such as shown in U.S. Pat. No. 1,862,679. Other types of cigarettes which are enclosed in wrappers which are perforated in one way or another to provide for safety features and/or control of sidestream smoke are described in Canadian Patent 835,684 and U.S. Pat. Nos. 3,220,418 and 5,271,419.

Devices which are mountable on the cigarette and which may be slid along the cigarette to control combustion and hence free-burn rate are described in U.K. Patent 928,089; U.S. Pat. No. 4,638,819 and International application W096/22031. The U.K. patent describes a combustion control device for cigarettes by limiting the flow of air to the cigarette burning ember. By retarding combustion of the cigarette, it is suggested that only half of the conventional amount of tobacco need be incorporated in the cigarette and result thereby in a shorter cigarette. The air flow limiting device may be provided by an array of apertures in the device with variable opening or by crimped portions in the device providing longitudinal openings along part of the cigarette. U.S. Pat. No. 4,638,819 describes a ring which is placed on the cigarette and slid therealong during the smoking process to control the free-burn rate of the cigarette and reduce sidestream smoke. The ring is of solid material, preferably metal, which causes considerable staining and due to variable cigarette diameters cannot reliably provide the desired degree of sidestream smoke reduction and extinguishing times.

An alternative ring system is described in applicant's published PCT application WO 96/22031. The device is provided with an inner ring which surrounds and contacts a conventional cigarette perimeter where the inner ring is of porous material. The outer ring encases the inner ring to direct air flow along the length dimension of the porous inner ring. The tortuous paths in the porous material of the inner ring controls the rate of air diffusion to the lit cigarette coal and thereby controls the free-burn rate of the cigarette. The porous material enhances the control of sidestream smoke emitted by the lit cigarette. The device may optionally extend up to one-half the length of the cigarette where air would have to flow along the inner porous ring to the burning coal.

Other systems which have been designed to control sidestream smoke are described in published PCT application WO 95/34226 and U.S. Pat. No. 5,592,955 issued Jan. 14, 1997 and U.S. Pat. No. 5,105,838 issued Apr. 21, 1992. These references describe various tubular configurations in which a tobacco element is placed in an attempt to minimize cigarette sidestream emission.

Although these approaches may have met with various degrees of success, in controlling sidestream smoke emissions, there are problems with some of the devices in providing conventional taste and flavor, ease of use, ease of manufacture, streamline appearance and significant reductions in the amount of tobacco used. The various embodiments of this invention provide a device which overcomes a number of the above problems by controlling both sidestream smoke and free-burn rate while achieving taste, flavor and constituent deliveries comparable to conventional cigarettes. The device of this invention permits the smoking of a thinner cigarette which has only as much tobacco as is necessary to deliver the desired taste while achieving the conventional number of puffs.

In order to facilitate the description of the invention, the term tobacco charge shall be used in referencing a cigarette, cigar, cigarillo, tobacco rod in a porous mesh, a tobacco plug or wrapped tobacco or the like. It is also understood that where the term cigarette is used, it is interchangeable with cigar, cigarillo and the like.

SUMMARY OF THE INVENTION

In accordance with an aspect of the invention, a device for minimizing cigarette sidestream smoke and reducing free-burn rate of a burning cigarette in combination with a filter tip, A) said device comprising:

i) a non-combustible porous tubular element encasing an effective length of a tobacco charge of a cigarette located in said tubular element, said tubular element having an open end adjacent a distal end of said cigarette to permit lighting of the cigarette distal end and to permit ingress of air; and ii) said tubular element having a predetermined porosity along at least its length which encases said effective length of said tobacco charge for both minimizing sidestream smoke emission from a burning tobacco charge and reducing free-burn rate of such burning tobacco charge to increase number of puffs from such burning tobacco charge, where said predetermined porosity for said tubular element:

a) retains around a burning ember of said cigarette oxygen deprived combustion gases within said tubular element to reduce rate of combustion and minimizes release of smoke particles through said porous tubular element; and b) restricts inward flow of air to reduce free-burn rate of said cigarette; and B) said filter tip comprising an inlet end and an outlet end, said inlet end having an annular sleeve with a central bore to receive an end of said cigarette, said annular sleeve having an outer shoulder onto which said tubular element is friction fitted, said central bore being in communication with a first inner tube of a first filter material, said tube having a closed end opposite its end in communication with said sleeve central bore, an annular space being provided outside of said first tube, a filter plug provided downstream of said annular space and filling said outlet end of said filter tip, a plenum between said filter plug and said first tube for transferring filter smoke from said annular space to said filter plug.

The openings in the tubular element in forming the predetermined porosity may take on various shapes such as narrow slits, slots or pores where the slits and/or slots may be covered with a porous matt of carbon fiber, glass fiber, ceramic fiber, high temperature plastic fiber, metal fiber and the like. The pores may be fabricated in the tubular wall of the element such as by punching to form fibrous projections within the tube where such projections may be relied on to center a cigarette in the tubular element. Alternatively, the tubular element may comprise a body portion of porous materials which perform the functions of retaining at least some of the oxygen deprived combustion gases within the tube and restrict inward flow of air to reduce free-burn rate of the cigarette.

In accordance with another alternative, the tubular element may be of a heat treated ceramic material which is rendered porous by the heat treatment. The makeup of the ceramic precursor material and the heat treating are carried out in a manner to provide the desired predetermined porosity.

In any of the above devices it is understood that the cigarette may be sufficiently thin to provide an overall dimension for the device which is that of a normal cigarette. The thin cigarette may have a diameter ranging from about 4 to 8 mm and preferably, about 4 to 6 mm and most desirably, about 4 mm. A catalytic material may be incorporated in the tubular element particularly when formed from ceramic. The catalytic material may either be coated on the tubular element or may be activated in the tubular element during heat treating of the ceramic precursor. The catalyst may be selected from a variety of well known groups including those which are based on precious metals and rare earth metals and in particular, based on platinum or cerium.

DESCRIPTION OF THE DRAWINGS

Various aspects of the invention are shown in the drawings wherein:

FIG. 9 is an exploded view of an alternate device;

FIG. 10 is a section of an end of the device;

FIG. 11 is an exploded end view of the device of FIG. 10;

FIG. 23 is an exploded view of an alternative embodiment for the filter tip;

FIG. 24 is a section through the assembled device of FIG. 23; and

DETAILED DESCRIPTION OF THE PREFERRED EMBODIMENTS

Figure 1:
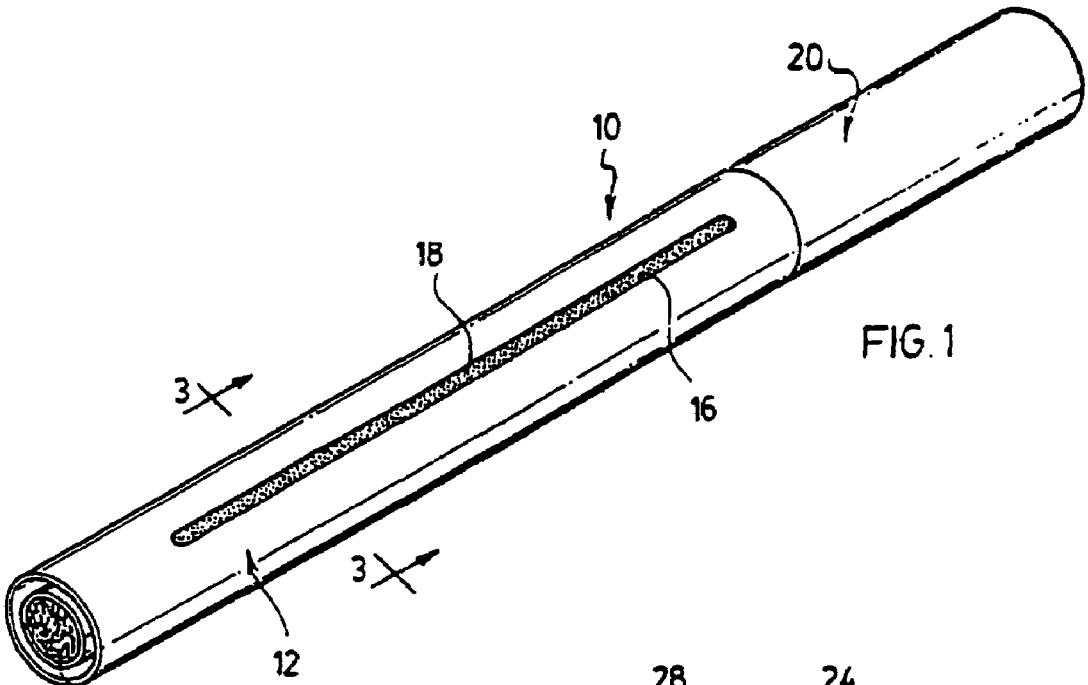
FIG. 1 is a perspective view of the preferred embodiment of this invention showing the device in which a cigarette tobacco charge is encased.

The device in accordance with this invention for minimizing sidestream smoke from a tobacco charge such as in a cigarette while controlling free-burn rate, has many features and advantages. The device, which in essence by encasing a tobacco charge, has a low ignition propensity to provide significant safety features should the lit charge be accidentally set down on ignitable materials. The device minimizes sidestream smoke emitted from the tobacco charge due in part to the free-burn rate control aspect of the device. This device has the surprising benefit of providing sidestream smoke control and free-burn rate control while encasing the tobacco charge, yet is capable at the same time of providing all of the normal features in smoking a conventional cigarette such as appearance, feel, taste and flavor. Catalytic materials may be incorporated or coated on the device to promote further combustion of various gases to avoid any off smell from the device as a cigarette is burning therein.

The device also permits the use of a non-conventional thin cigarette which is considerably thinner than a conventional cigarette and may contain up to ⅔ less tobacco in the tobacco charge, hence, very significant tobacco and material cost savings in the manufacture of cigarettes to be used with the device. More particularly, a very thin or slim cigarette which is non-conventional in the reduced number of puffs and involving significantly ⅔ less tobacco, may be used. The device with the thin non-conventional cigarette provides the smoker with normal inhale pressures, normal quantities of inhaled smoke, normal flavor and taste and normal number of puffs. The thin non-conventional cigarette cannot offer all of these features together if smoked without the device.

An unexpected advantage which flows from the use of a thin non-conventional cigarette for use in this device is that the smaller diameter of the thin cigarette ensures proper burning during the idle phase to avoid off-taste. The device in controlling free-burn rate ensures that the lit cigarette during the idle phase considerably slows down the rate of advance of the burning coal. By virtue of the smaller diameter for the thin non-conventional cigarette, the burning coal extends across the face or the cross-section of the smaller diameter cigarette. This is quite different from what happens with a conventional size cigarette when the free-burn rate is controlled. In a conventional cigarette, due to the excessive amount of tobacco in the larger cross-section, the coal burns inwardly of the cigarette central portion during the idle phase and allows condensation of smoke products in the outer portion of the cigarette. This would appear to be a particular result when the prior art types of free-burn rate control devices are used. Unlike that arrangement, the arrangement according to a preferred embodiment of this invention which involves the thin non-conventional cigarette, is that the coal as it extends across the face, ensures proper burning even during the idle phase so that combustion products do not condense in the outer portion of the slim cigarette. When the cigarette is then picked up again for the next puff, the inhale step causes the coal to rise immediately to temperature and advance quickly along the thin cigarette thereby avoiding any off-taste because the coal is immediately up to normal smoking temperature. It is also a feature of the invention, that the thin non-conventional cigarette may be thinner than the normal slim cigarette of about 5.5 mm to 6 mm. The non-conventional cigarette is a novel structure in the marketplace when its diameter is less than 5.5 mm and particularly when less than 5.2 mm. The thin cigarette as preferably used in the device, is non-conventional in terms of number of puffs and size. The size is not only different in respect of diameter but possibly the length as well. The thin cigarette as with a conventional cigarette, has a suitable wrapping which is ideally the usual form of cigarette paper having the usual composition and porosity. The paper may also include common burn rate modifiers to further retard the free-burn rate of the cigarette such as the burn rate modifiers described in U.S. Pat. No. 4,679,575.

A further significant benefit which flows from the use of a thin cigarette in the device is that the excessive tobacco in a conventional sized cigarette burns off as sidestream smoke. With the free-burn rate control of this device, there is minimal waste of tobacco during the idle phase. Instead, what would have been waste in providing sidestream smoke, during the idle phase of a conventional cigarette becomes mainstream smoke on the next puff thereby increasing yield per unit of tobacco.

Some or all of the features of this invention may be attained by one or more of the following embodiments of the invention, as particularly described with reference to the drawings. In FIG. 1, the device 10 has a tubular element 12 for encasing a cigarette 14. The device 12 extends over the effective length of a tobacco charge for the cigarette. Effective portion of the tobacco charge of the cigarette is intended to include the length of a cigarette which would be normally smoked in order for the smoker to achieve the usual number of puffs (normally eight to ten) as per a conventional cigarette. The device 12, in accordance with this particular embodiment has several openings 16 in its periphery, one of which is shown in FIG. 1. The opening 16 is preferably a slit extending longitudinally of the device 10. The opening of the slit 16 supplies air to the burning cigarette to support combustion where along the length of the opening, a component 18 is provided for effecting free-burn rate control while achieving in the same device, that is, simultaneously minimization of the sidestream smoke emitted from the burning cigarette. In conforming with a conventional cigarette, the tubular element 12 has connected thereto or integrally formed therewith a filter tip portion 20 for purposes of filtering in the usual manner mainstream smoke inhaled from the burning cigarette.

Figure 2:
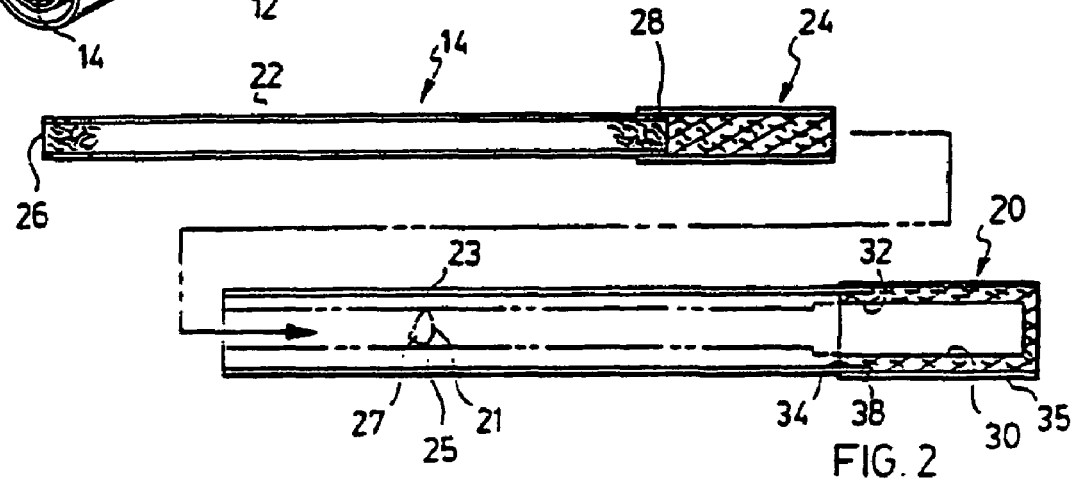
FIG. 2 is a section along the device of FIG. 1.

As shown in FIG. 2, the tubular device 12 encases the cigarette 14 which has a wrapped tobacco rod portion 22 and in accordance with this particular embodiment, a filter tip portion 24. The device 12 preferably extends from the distal end 26 of the tobacco rod 22 to at least the filter tip line 28. The slit 16 extends to at least the rearward portion of the effective length of the tobacco rod 22 to ensure that the cigarette continues to burn for at least the number of puffs associated with a conventional cigarette. The cigarette may then be extinguished by smoking the tobacco rod close to the filter tip line 28 or by virtue of the slit terminating forwardly of the tobacco line 28 so that insufficient air reaches the burning end portion of the cigarette and it extinguishes before reaching the filter tip line 28. The filter tip portion 20 has a bore 30 provided therein to receive snugly the filter tip 24 of the cigarette and thereby support the cigarette as it extends out from the tip 20. It is appreciated that the cigarette 14 may only have a wrapped tobacco rod 22 and no filter. In this arrangement, the tobacco rod end would be inserted in and supported by the filter tip 20. The bore 30 of tip 20, defines a blind hole, so that the hole does not extend through the tip 20. The tip 20 has a reduced neck portion 32 to define a land 34 over which the tubular element 12 is slid to provide the assembled unit of FIG. 2. Tipping paper 35 completes the assembly where the land portion 34 may be sealed to prevent air entering the tip 20 from the gap between cigarette and tube. With the inner edge 36 of the tubular element 12 contacting the abutment 38 of the tip 20, the assembled unit appears seamless and hence, resembles a conventional looking cigarette in the manner shown in FIG. 1.

Figure 3:
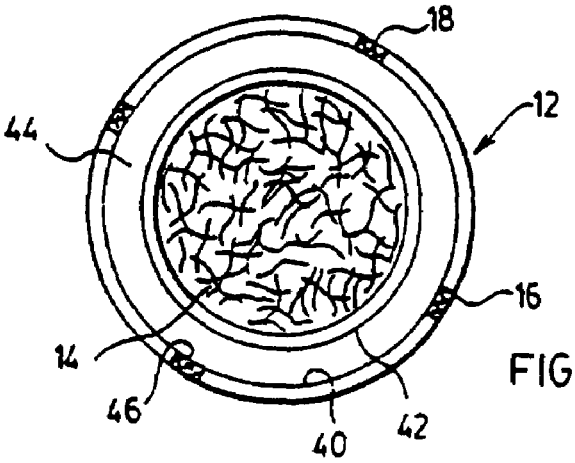
FIG. 3 is a section along the lines 3-3 of FIG. 1.

By virtue of the tip 20 supporting the cigarette, the tobacco rod portion 22 is positioned substantially concentrically within the tubular element 12. In accordance with this particular embodiment, the tubular element 12, as shown in FIG. 3, has an inside diameter defined by the interior surface 40 which is spaced from the exterior surface 42 of the cigarette paper periphery. Such spacing defines an annulus or gap 44 extending along the length of the device 10 to the connection of the tubular element 12 with the device tip 20. The annulus 44 in conjunction with the component 18 in the opening 16, perform in combination the control aspects required in minimizing sidestream smoke and reducing free-burn rate of the cigarette.

The tubular element 12 is formed of a cigarette smoke impervious material. In order to maintain the structural integrity of the tubular element 12 during the smoking process, the material is non-combustible and is able to withstand the temperatures of a burning coal receding inward along the tubular element during the smoking process. Similarly, the component 18 in the openings 16 is non-combustible to ensure all aspects of sidestream smoke control and free-burn rate control are achieved while smoking the cigarette. The non-combustible aspect of the tubular element 12 also permits re-use of the device for smoking a package of cigarettes, by simply removing the tubular element 12 from the tip 20 and withdrawing the cigarette 14 from the tip 20. The device is then ready for re-use by inserting a fresh cigarette 14 in the tip 20 and re-assembling the tubular element 12 on the tip 20. It is understood of course that all cigarettes in the package may come equipped with the device 10 and simply discard the unit when the cigarette is smoked.

As shown in the enlarged view of FIG. 3, the slit 16 defines an opening 46 having the component 18 provided therein to effect control of the cigarette free-burn rate and minimize sidestream smoke. Depending upon the shape and size of the slits 16, a sufficient number are provided along the tubular element 12 to ensure with the components 18 in place that sufficient air reaches the effective portion of a tobacco rod to maintain the desired free-burn rate in providing the usual number of puffs equivalent to a conventional cigarette. The component 18 is preferably of a porous material which is non-combustible. The porous material may be formed from carbon fiber, preferably activated carbon fiber, ceramic fiber, glass fiber, high temperature plastic fiber, metal fiber, synthetic wood derived materials of a porous nature (briar wood) and the like. The fibers may be in long strand form or may also be matted or in some way formed into a matt or sheet and rendered porous by physically making minute pores in the material, (ie., by laser drilling, by chemical leaching of soluble minute particulars from matt or mild calcining to remove combustibles from the material).

The porous material may be in the form of a matt or sheet and may be woven to provide a degree of porosity which for the number and size of selected slits 16, provides the necessary control in achieving the desired free-burn rate of the cigarette. The placement of component 18 which may be the porous woven or non-woven, matt or sheet of non-combustible material may be just in the slit 16 as shown. This may be done by dipping the tubular member 12 in a slurry of the fibrous material, which is used to form the matt. Preferably the fibrous material is activated carbon fiber in an aqueous slurry optionally in combination with a suitable binder and possibly catalytic materials. Once the slurry has dried and thereby filling the slits 16, any excess is removed from the interior surface 40 of the tubular member 12.

Figures 4, 5:
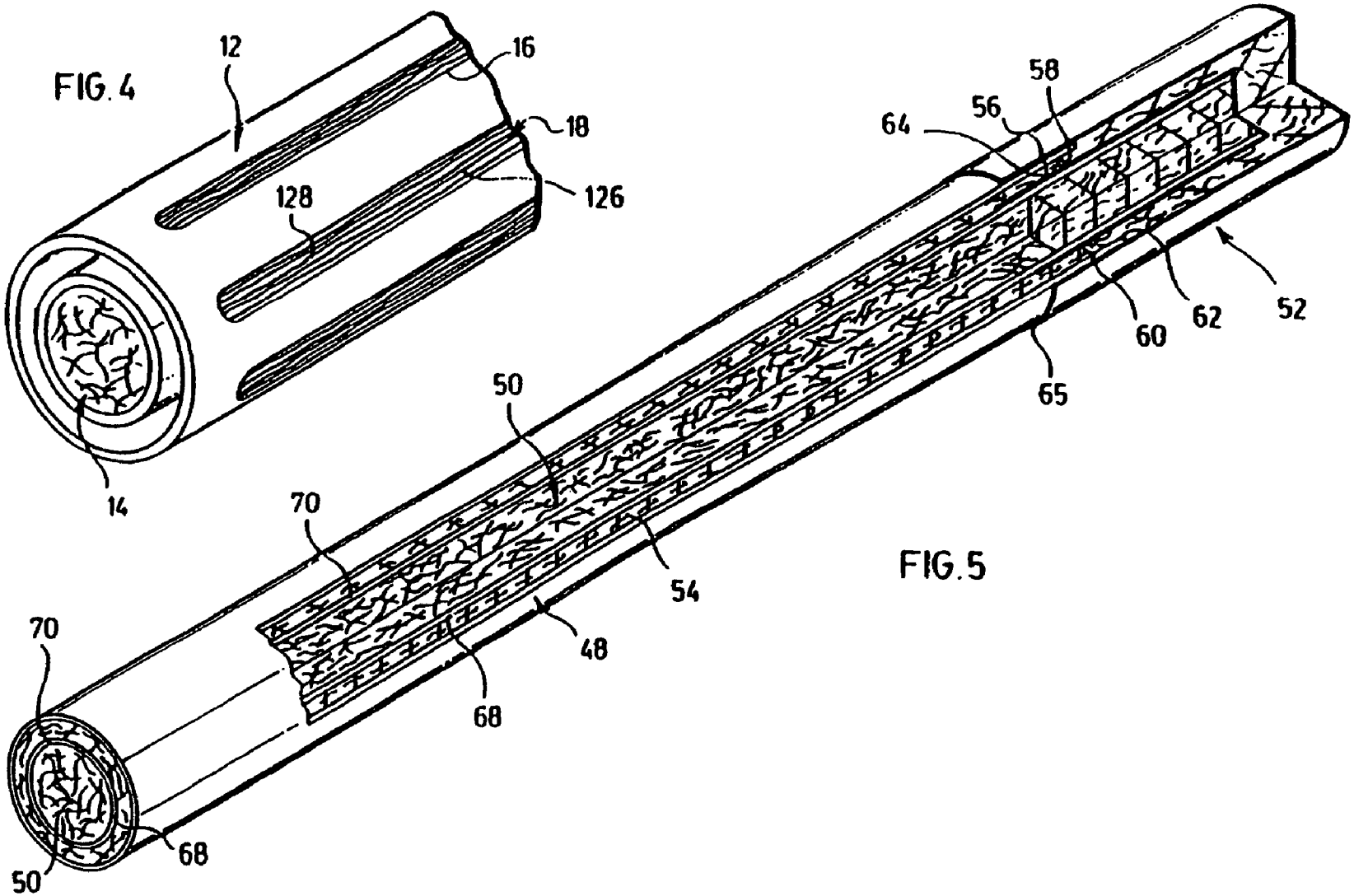
FIG. 4 is the enlarged view of an end view of the device.
FIG. 5 is a perspective view of an alternative embodiment of this invention showing the device encasing a tobacco charge of a cigarette.
Figure 6:
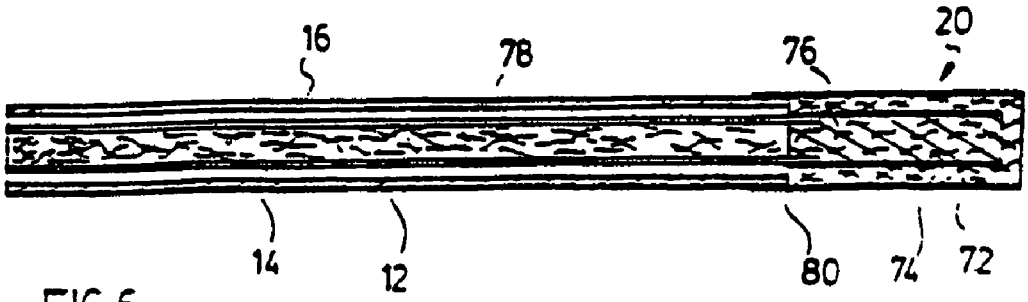
FIG. 6 is a section along an alternate device.
Figure 7:
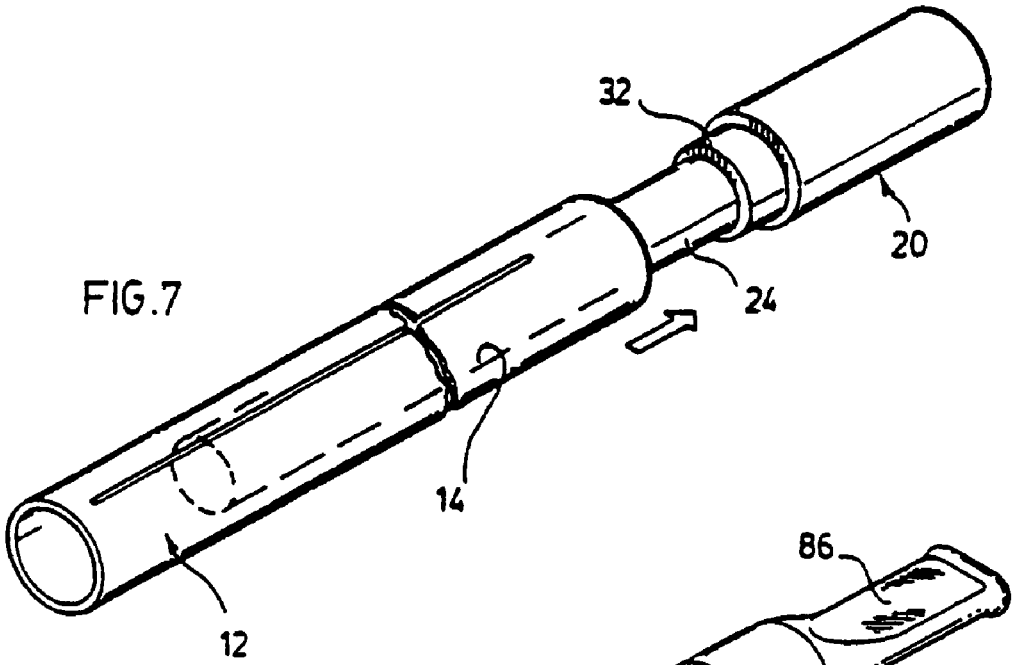
FIG. 7 is an exploded view of the reusable device.
Figure 8:
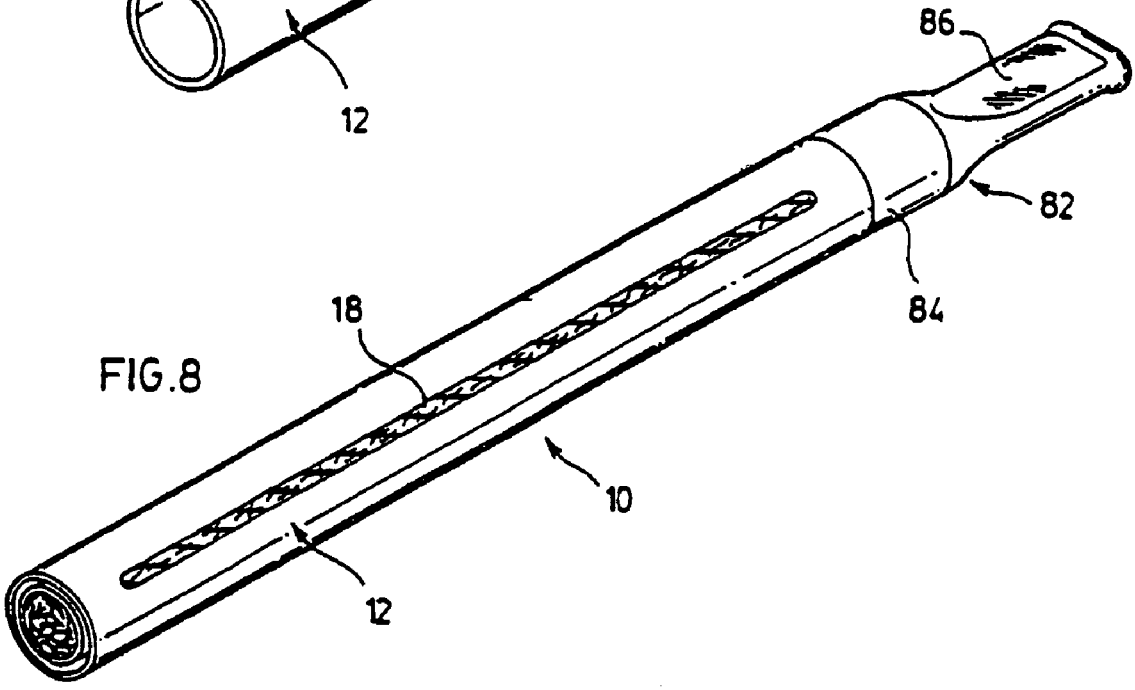
FIG. 8 is a perspective view of the device with a mouthpiece or tip.

The porous material for the slits may be long strands positioned within the slits instead of being matted or woven into a sheet. This alternative embodiment as it would apply to longitudinally extending slits in the tubular member is shown in FIG. 4. The tubular element 12 has the longitudinally extending slits 16 filled with a porous material 18 as in the earlier described embodiment of FIG. 1. The difference however is the composition for the fibrous material 18, as shown in more detail in FIG. 4. Instead of a matting, as described with respect to FIG. 3, the fibrous material is in the form of longitudinally extending strands 126 which extend along the length of the slit 16. The strands of material may be of glass, plastic, metal or carbon fiber and the like. Preferably, the strands 126 are of an activated carbon fiber. A sufficient number of strands are located within the slit 16 to define spaces or in essence very long and narrow pores 128 between the strands which perform the necessary dual function of sidestream smoke control and free-burn rate control. Preferably, the strands are of hair-like diameter in order to increase the number which may be provided in the slits and at the same time significantly increasing surface area for the fibrous material to work on the sidestream smoke control while providing an acceptable pressure drop to simulate normal inhale pressures on cigarette. The strands are located along the slit and may be secured at various intervals along the slit to ensure that the strands do not fall out of the slit during packaging or use.

The conventional wisdom in respect of free-burn rate control is to restrict the flow of air to the burning coal of a lit cigarette. By restricting air flow, the free-burn rate of the cigarette is reduced because rate of combustion is retarded. Although this approach has been successful in controlling free-burn rate, such devices may restrict the flow of air when the smoker draws on the cigarette.

The device in accordance with this invention would not however appear to be functioning in a conventional manner for controlling free-burn rate. Although the porous material 18 and/or slits 16 sizing may restrict air flow, the porosity and pore size may be selected such that at least some of the hot oxygen deprived gases of combustion are retained by the tubular element 12 in the annulus region 44 of the burning ember. As shown in FIG. 2, the burning cigarette has an ember or coal 21 receding in tube 12 to the position shown in dot. The usual ash cone 27 is behind the advancing ember 21. The hot combustion gases are located in the annulus or gap 44 as developed by the burning ember such as indicated at 23 and 25 above, below and around the cigarette. At least some, if not substantially all or a majority of the hot gases retained in regions 23 and 25 around the burning ember 21, is believed due to the selected porosity of the openings 16 and/or the porous material 18. In controlling sidestream smoke, the porosity and pore sizing is selected to retain preferably a major portion, if not substantially all the hot gases and thereby develop in the region of the ember 21 an oxygen deprived gas. The porosity of the tubular element 12 not only restricts air flow, but as well is believed to contain the hot oxygen deprived combustion gas and thereby starve the burning ember and reduce rate of combustion and hence retard free-burn rate of the cigarette. The porosity of the material is selected to ensure that flow of air into the tube during the idle phase of the cigarette is minimal. This action maintains the level of oxygen deprived gases in the region of the burning coal and thereby keeps the free-burn rate of the cigarette at the desired minimum burn rate. When a smoker draws on the device, air is drawn in through the openings and/or porous material in the tubular element as well through the open end to supply the needed air to support burning during the puff phase. Once the smoker stops drawing on the cigarette, the contained oxygen deprived combustion gases in the region of the burning ember immediately retard rate of combustion and thereby reduce free-burn rate. With this guidance, it is appreciated that the pore sizing in the tube may vary depending on a number of factors including type of tube material physical properties, composition and type of pore openings. It has been demonstrated on a repeated basis that some testing may be required in selecting various pore sizings which provide the necessary tube porosity for controlling free-burn rate and sidestream smoke.

This approach to controlling free-burn rate is quite different from many of the prior art devices which are primarily focused on controlling air flow to the burning ember. The device in accordance with this invention retains the developed hot gases in the region of the burning ember by providing an enlarged region in the annulus to contain the larger volume of hot gases compared to the smaller volume of fresh air needed to support combustion. By providing an annulus of open space or filled with porous material, as will be described with respect to FIG. 5, minimal but sufficient volumes of air to support and maintain minimal combustion during free-burn and commencement of puffing on the cigarette are provided. As the puff on the cigarette continues, additional air is drawn through the tubular element openings and also through the modular element open end.

The porous material also has the capability of adsorbing or absorbing various particulate components and aerosol of the sidestream smoke and capturing such material so that in the event the device is re-used the captured smoke particulates are not released to affect the flavor and taste of a replaced new cigarette to be smoked. The preferred carbon material for the porous material is commonly sold in the form of a mat or sheet which may be matted or woven and thereby facilitates its application to slits 16 in the device 12. The carbon fiber material may cover the entirety of the tube interior or just cover the slits. Alternatively, the long strands of carbon fiber may be located in and along the slits 16 in a manner to be described with respect to FIG. 4.

It is appreciated that the openings formed in the tubular element of the embodiment of FIG. 1 may be formed therein by laser cutting, high speed saw cutting, stamping, punching, piercing and the like. The porous component 18 may be applied to the openings by dipping the tubular element in a slurry of the fibrous material to form a porous fibrous matt in the openings. When the slurry is dried within the tubular element, excess fibrous material within the tubular element may be removed. It is also understood that fibrous material may be precisely positioned in the slit 16 and heated with a laser beam somewhat similar to the manner in which laser printing is accomplished on paper.

The tubular element 12 is formed of a non-combustible material which may preferably be ceramic, high temperature plastic, treated paper or porcelain paper, synthetic porous wood derived materials or sheet rolled and secured to form the desired size for the tubular element. The interior may be coated with catalytic particles to catalyze oxidation of carbon and nitrogen containing gases given off from the primary burning of tobacco. Preferably, the exterior of the tubular element 12 is white to resemble cigarette paper or when used on a cigar, is a tan color to resemble a cigar wrapper. Alternatively, the tubular member could be wrapped in a cigarette paper of sufficient porosity. The tip 20 may be a normally constructed filter element of a conventional cigarette with sufficient structural integrity to maintain the bore 30 therein to receive the tip portion 24 of the cigarette 14. The tip portion 20 may be wrapped in a suitable paper or like material so that the assembled unit of FIG. 1 looks like a conventional cigarette. It is appreciated that the tip portion 20, when used with a cigar, may be formed to look like the conventional tip of a cigar or the conventional mouthpiece commonly used with cigars.

The further embodiment of the invention, as shown in FIG. 5 demonstrates an alternative arrangement for the tubular element 48 of the device 10. The tubular element 48 encases a cigarette 50 and has a suitable tip 52. The tubular element 48 is formed from a substantial thickness of non-combustible porous flexible material. The thickness of the porous material is considerably thicker than the thickness of the porous material used in component 18 of the embodiment of FIG. 1. The porous material may be of the same makeup as the material of component 18. It may be a sheet or a matt, with pores formed therein or a matted or woven carbon fiber, preferably activated carbon fiber, glass fiber, ceramic fiber, high temperature plastic fiber, metal fiber and the like and may optionally include catalytic particles to enhance continued combustion of gas from the burning tobacco. The tubular component has the porous material 54 extending the length of the tubular element 48 to the filter tip line 56 of the tip 52. The porous material, as with the embodiment of FIG. 1, extends along the tubular element for the effective length of the tobacco rod to be smoked so as to simulate the same conditions in smoking a conventional cigarette. The tip 52 is constructed in a manner similar to the tip 20 of FIG. 1. The tip 52 has a reduced portion 58 defining a land 60 with an abutment or stop 62. The tubular element 48 has an end portion 64 and is dimensioned to abut the land 60. Tipping paper 65 is used in the conventional manner to complete assembling of the tubular element 48 to the tip 52. The cigarette 50 fits within the bore 66 in a manner described with respect to FIG. 2. The cigarette 50 is then supported by the tip 52, where such support is enhanced by the tubular element 48 contacting or engaging cigarette periphery. This aspect also permits the manufacture of a cigarette which does not have all the usual characteristics of a conventional cigarette, such as, firmness, strength, end fallout and the like. The same may apply to the device of FIG. 2 because the cigarette is housed in the tubular element and is thereby protected and not subject to constant tapping to remove ash as would be the case if the cigarette were smoked apart from the device. It is also understood that the tubular element of FIG. 2 may have internal ribs to support the cigarette concentrically in the tube. The device of this invention allows for the use of a cigarette which may be made in a somewhat non-conventional manner. A number of the standard production processes may be avoided, such as, use of expanded tobacco, shredded or enhanced stem and the like which were required to provide desired cigarette firmness and appearance. Furthermore, the thin cigarette may be made with less tobacco in total and thereby requires considerably less quality tobacco.

As shown in FIG. 5, the tubular element 48 has an internal diameter defined by interior surface 68 which is essentially the same as the external diameter of the periphery 70 of the cigarette 50. The tubular element 48 is then slid over the cigarette 50 where the periphery of the cigarette is in essence in contact with the interior surface of the tubular element 48. The tubular element 48, in being made of non-combustible material retains its structural integrity as the cigarette is smoked and recedes within the tubular element. The tubular element 48 simultaneously minimizes sidestream smoke from the burning cigarette as well as controlling the free-burn rate of the cigarette. Such retention of the sidestream smoke in the tube is achieved by the porous material absorbing and capturing the smoked particles and aerosols of the sidestream smoke. In addition, if catalytic particles are embedded in the porous tubular material, the odor causing constituents of the aerosols may be oxidized into odorless constituent or pleasant smelling constituents.

The porous material is of a structure in the form of a mat or sheet or the like which is capable of capturing such particles and aerosol and retaining them so that they are not released during the smoking of a new cigarette in the device in the event that the device is re-used. Furthermore, the porosity of the porous material is selected to control air flow and retain hot combustion gases in the region of the burning cigarette ember to achieve the desired reduction in free-burn rate so that smoking of the cigarette simulates the number of puffs associated with smoking of a conventional cigarette.

The tubular element 48 may be formed from a single sheet or mat. Alternatively, the tubular element 48 may be formed by layering several sheets or thin mats of the porous material to form the desired thickness for the tubular element. The tubular element may include an outer coating or wrapper such that the exterior of the tubular element resembles in color, a cigarette or cigar. It is appreciated that such coating or wrapping must be porous to the extent that it does not appreciably interfere with the control that the porosity of the tubular element 48 provides in achieving the desired free composition which is capable of repeatedly changing color as the burning coal moves inwardly of the tubular element 12.

Figure 18:
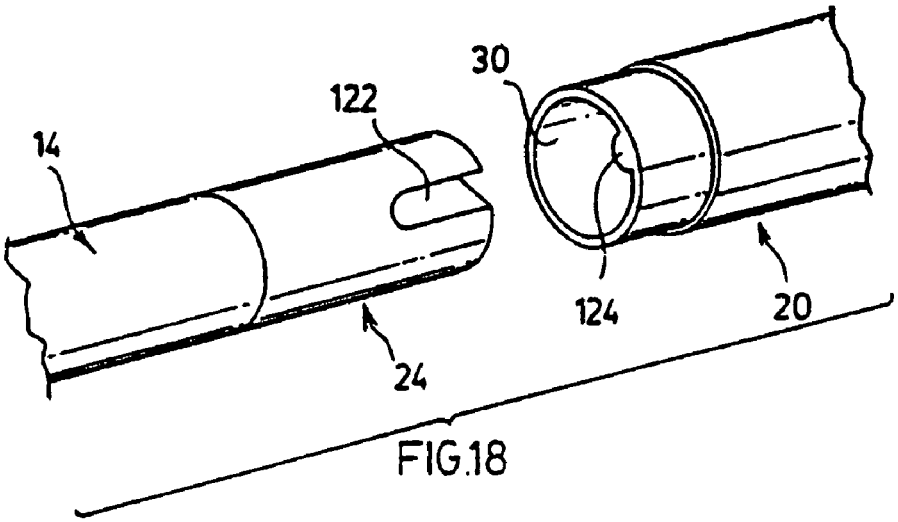
FIG. 18 is an exploded view of a cigarette tip adapted to fit a holder with detent.

In order to achieve a unique interfit of cigarette tip with holder, a mating cigarette tip configuration and holder interior may be provided, as shown in FIG. 18. A cigarette 14 has its tip portion 24 formed with a longitudinally extending recess 122. The holder tip portion 20 has a detent 124 extending longitudinally inwardly of bore 30. The shape of the recess 122 is such to form a mating fit with detent 124, and thereby ensure that only cigarettes designed for use with this holder 20 may be used in the device. Such design may be relied on to ensure, for example, that correct length of cigarette is used with the correct filter size in tip 20 or that the correct cigarette brand is used in the device.

Figure 12:
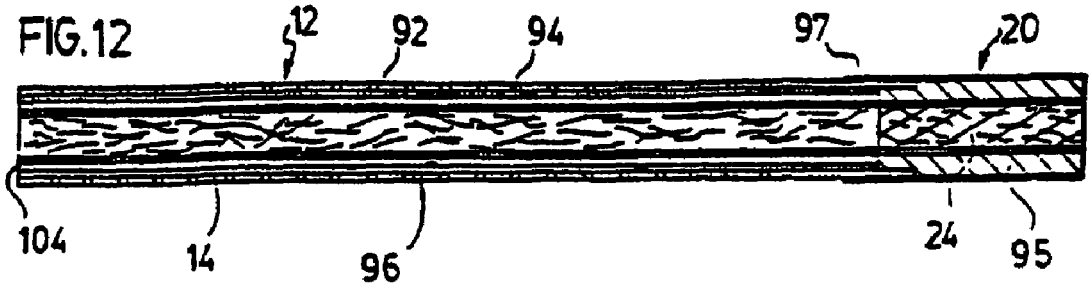
FIG. 12 is a longitudinal section of an alternative structure for the device of FIG. 1.
Figure 13:
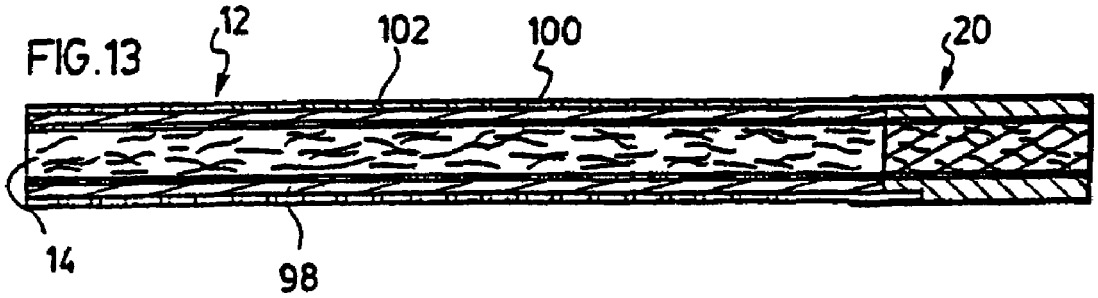
FIG. 13 is a longitudinal section of an alternative embodiment for the device of FIG. 12.
Figure 14:
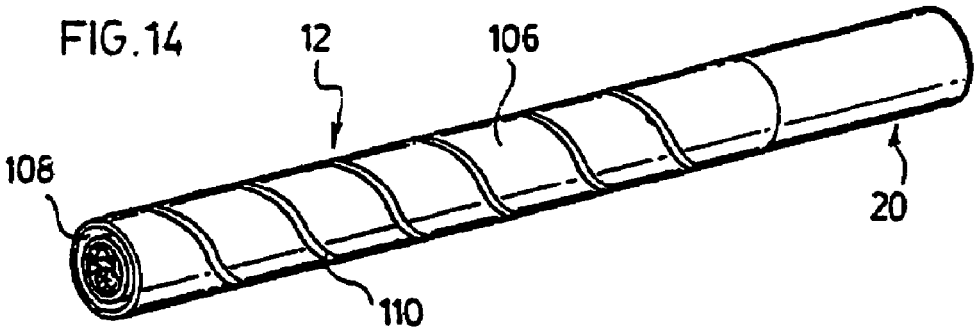
FIG. 14 is a perspective view of an alternative spiral wrap construction for the tubular member.
Figure 15:
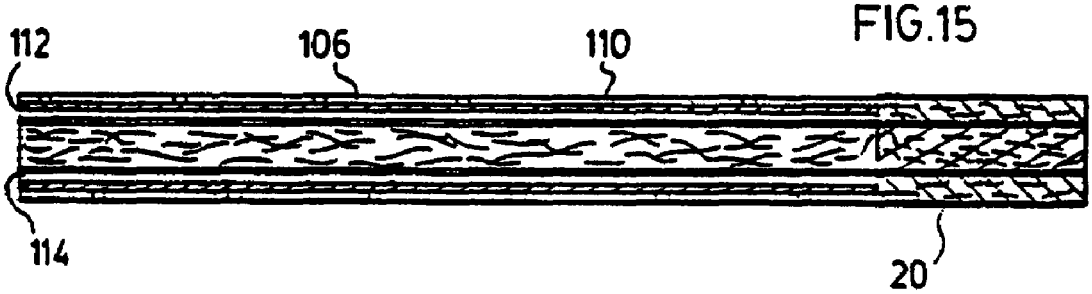
FIG. 15 is a longitudinal section of the spiral construction of FIG. 14.
Figure 16:
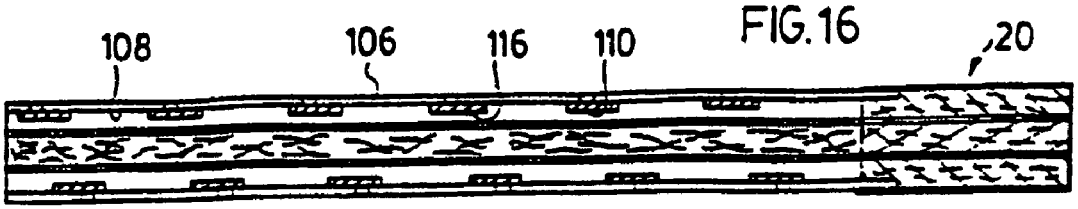
FIG. 16 is a longitudinal section of an alternative construction for the spiral configuration of FIG. 14.
Figure 17:
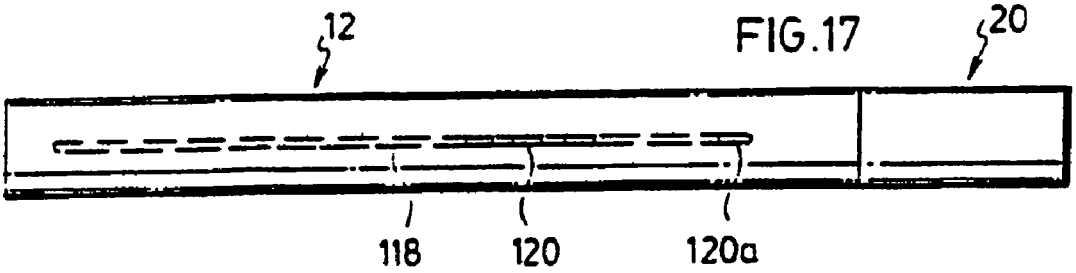
FIG. 17 is a plan view of the device with a temperature indicator.
Figure 19:
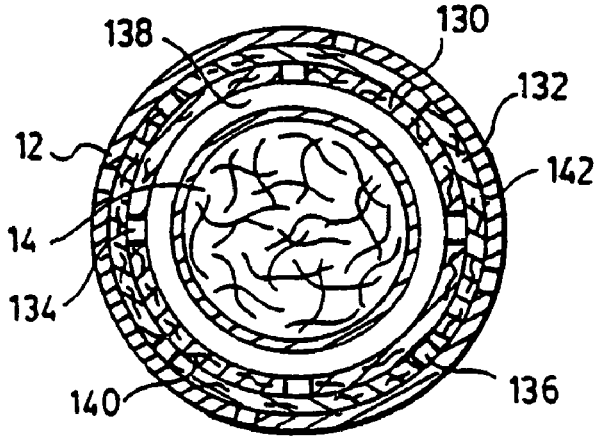
FIG. 19 is a cross-section through an alternative embodiment for the tubular element.
Figure 20:
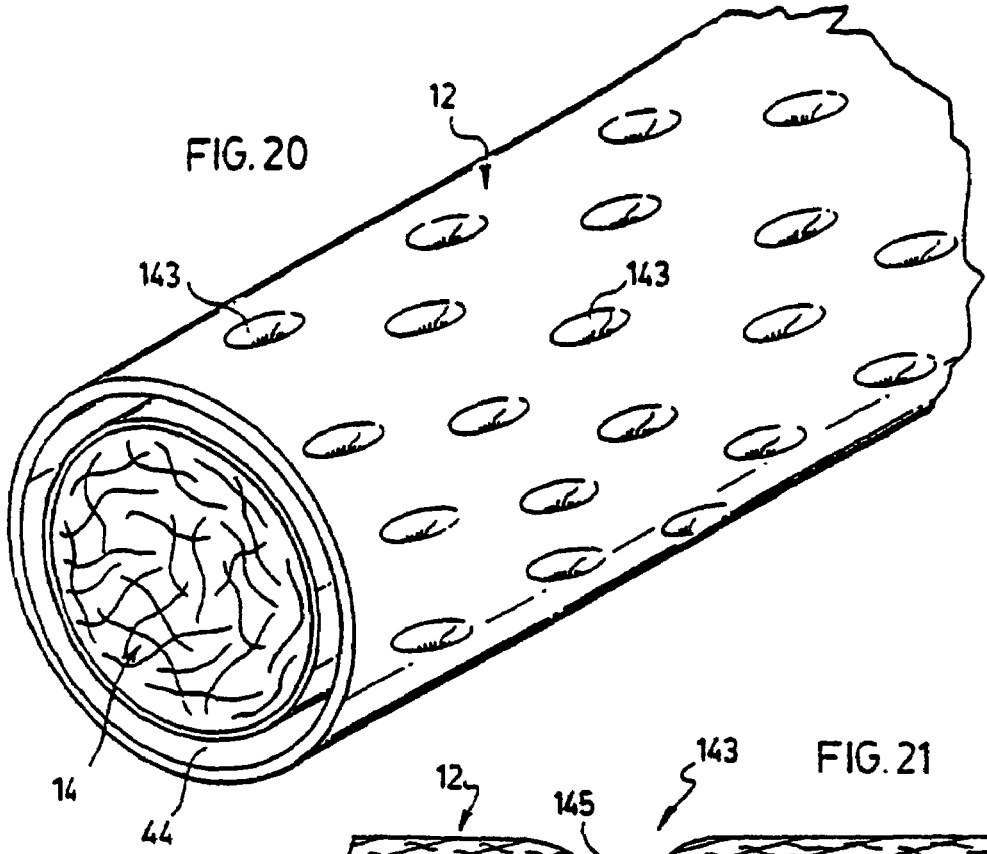
FIG. 20 is a perspective view of an alternative embodiment for the tubular element.
Figure 21:
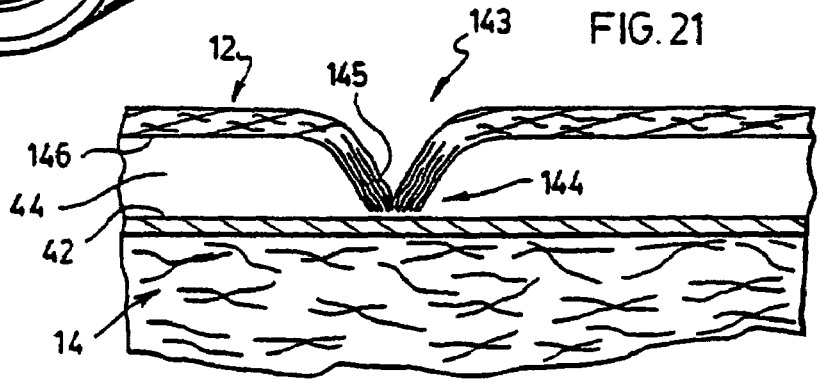
FIG. 21 is a section of FIG. 26.

Another alternative embodiment for the tubular member 12 is shown in FIG. 19 where a tortuous path for the flow of air into the tubular member and for the sidestream smoke toward the exterior of the tubular member is shown. A cigarette 14 is surrounded by three concentric tubes. The first two inner tubes 130 and 132 have longitudinal slits defined therein similar to that of the tubular member 12 which is the outer tube. The inner tube 130 has its slits 134 offset from the slits 136 of the adjacent tubular member 132. An annular space 138 is provided between the cigarette periphery in the interior of tubular member 130. A thin space 140 is provided between tubular members 130 and 132 and as well a thin space 142 is provided between tubular member 132 and tubular member 12. Such narrow spacing between the tubular members provides a controlled degree of communication between the openings in the respective tubes in forming the tortuous flow paths. Tubular member 12 has positioned therein the usual matting, woven fiber or stranded fiber to provide for the free-burn rate control and sidestream smoke control. The sidestream smoke as it emanates from the burning cigarette 14 travels outwardly through slits 134 and then follows a tortuous path between tubular members 130 and 132 to travel out through the apertures 136 which are out of register with the apertures 134 and then back through the space between tubular members 132 and 12 to encounter the porous material 18 in the outer slit 16 of the tubular member 12. By providing this tortuous path of that the tubular member 12 may be adapted to reduce the porosity of the mesh holding the tobacco rod to render it smokeable. This may be accomplished by providing within the tubular member 12, an inner sheath into which the tobacco rod is slid or to adapt the embodiment of FIG. 5 or 13 to encase and contact the periphery of the tobacco rod to provide the necessary reduction in porosity so that the tobacco rod may be smoked. Other variations for a normally non-smokeable product include modifying the cigarette filter 24 of FIG. 2 such that the filter wrapping paper or exterior is too porous to effect any draw on the lit tobacco charge. However, when the porous filter tip 24 of cigarette 14 is inserted in the tip 20, the interior of the bore in the tip 20 of for example FIG. 12, seals off the porous filter exterior so that the cigarette becomes smokeable. Another alternative is to position a strong unfiltered wrapped tobacco rod which is too strong to smoke normally, in the tip 20 to provide the desired filtered smokeable flavor and taste.

The device surrounding the cigarette or cigar, provides a significant safety feature should the device be accidentally set down on an ignitable material. The non-combustible tubular member contains the burning coal of the cigarette and prevents direct contact of the burning coal with the potentially ignitable material. This arrangement then greatly reduces the chances of accidental fires caused by a burning cigarette. In addition, the tubular element, either by virtue of the annulus or its thickness, provides a perimeter which although hot to the touch, is not at a temperature which would burn a smoker. Although the tubular element may become warm during the smoking process, it would not be so hot as to burn the user. The tubular element ends preferably with the end of the tobacco rod and may even be flush therewith. Because the tubular element is non-combustible, a flame may be applied to the end of the device to ignite the distal end of the cigar or cigarette so that smoking may commence.

As previously noted, a further benefit in providing the various embodiments of this invention is to include catalytic material or particles which function to convert odor causing gases into substituents which have less or no odor. Depending upon the efficiency of the sidestream smoke control aspect of the device, it has been observed that the only constituents escaping through the tubular element are invisible odorless gases. It is therefore important to reduce this smell either by allowing some of the smoke constituents to emanate as invisible vapors to mask the smell or to take steps to reduce the smell so that it is not noticeable during the smoking process. As is understood, considerable amounts of odor causing gases are emitted from a burning cigarette during the normal smoking process, however, strong smells from such odor causing gases are masked by all of the other constituents of smoke which are emitted with the sidestream smoke. It has been found however that suitable catalysts which may be of the precious metals, rare earth metals and the like, and mixtures thereof either as catalysts or metals in the catalyst. Preferred metals include platinum or cerium which may be used to oxidize the odor causing gases to render them odorless. The catalyst particles may be included in various aspects of the tubular member. They may be placed in the porous material, put in the various types of openings in the tubular member and, for example, when making the matted material 18, the catalytic particles may be included in the matting. Catalytic materials may be applied to the interior or exterior of the tubular member or may be adhered to the fibrous strands which are placed in the slits of the tubular member. It is also appreciated that the catalytic material may be applied as a thin film to the interior of the tubular member or in the apertures 104 of the embodiment of FIGS. 12 and 13. The catalytic material may be included as a heat treated material in the apertures 104 to provide further sidestream and free-burn rate control as long as the catalyst is positioned in an area where it achieves the desired oxidation of the vaporous materials in the aerosols which permeate the tubular member.

Figure 22:
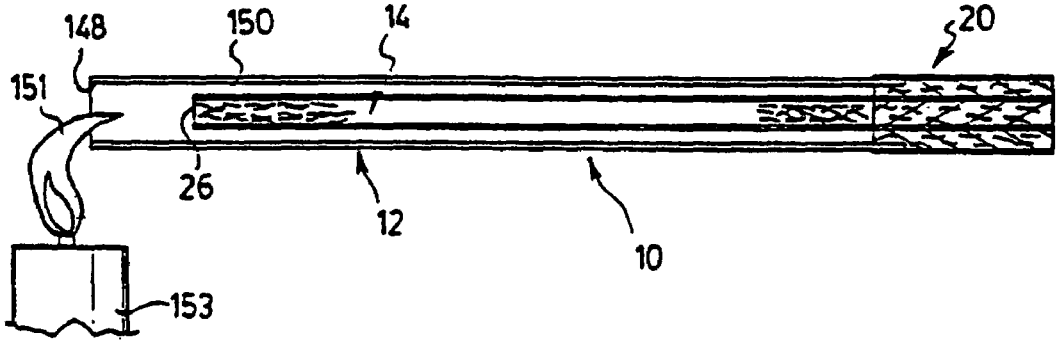
FIG. 22 is a longitudinal section view of an alternative embodiment for the tubular element having a porous wrap of ceramic sheet.
Figure 25:
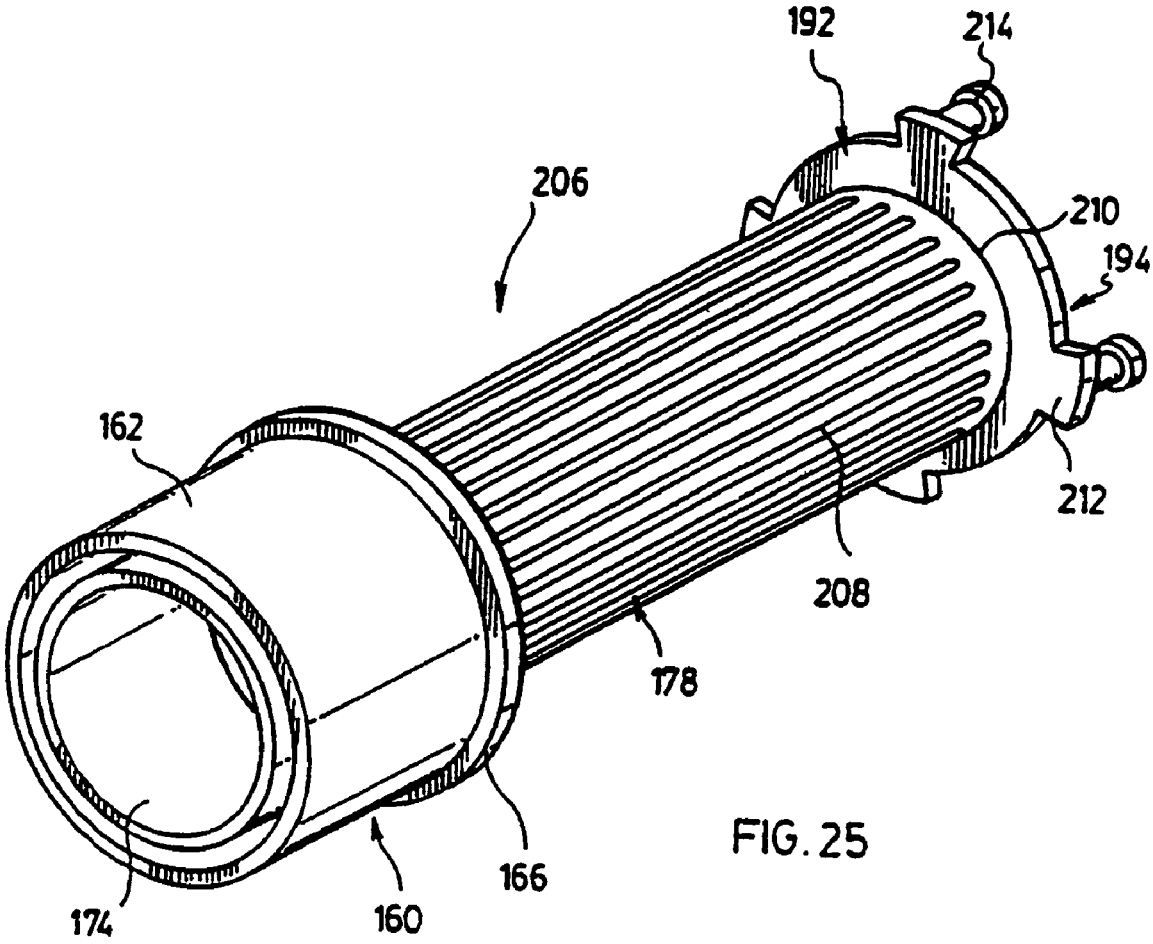
FIG. 25 is a perspective view of an injection molded component of the device of FIG. 23.

The catalytic material as included in the material for making the tubular member such as with the manufacture of the matt 18, has provided significant benefits in converting odor causing invisible gases to either odorless gases or gases with an acceptable odor and at the same time, allowing one to exercise additional control in providing the required predetermined porosity in the tubular element. The advantages are particularly apparent when the catalyst is used in the manufacture of the calcined tubular members of FIG. 22. The tubular member may be formed by wrapping two or more layers of the formed ceramic precursor sheet to provide a tubular shaped member. The sheet may be formed in the usual manner by making a slurry of the ceramic precursor material which includes clays, alumina sol binders, various types of organic binders, aluminum oxide and other normal constituents usually included in a ceramic precursor. In order to prepare the sheet, this slurry with high solids content is laid out in accordance with usual papermaking processes, rolled and dried to form a sheet of ceramic precursor material. The sheet is then, as previously noted, wrapped upon itself one or more times depending upon the thickness of the sheet to provide a tubular member of a desired thickness. In the manufacture of the sheet, catalytic materials and/or catalytic precursor materials may be incorporated in the slurry and either solubilized or dispersed in the slurry whereby the catalytic material, either in the form of a catalyst or precursor is correspondingly in the sheet material when wrapped into the tubular element and during the mild calcining of the tubular element. It has been found that the presence of the catalytic material provides an additional controlling factor in achieving a desired porosity in the tubular member and as well, by virtue of its in situ presence in the tubular member, provides enhanced oxidation of the odor causing gases as they pass through the tubular element. Such enhanced oxidation is compared to coating the tubular element on the inside with a catalytic material.

Although it is believed that a variety of catalytic materials may be used such as the previously mentioned catalytic materials based on precious metals, rare earth metals and the like which include platinum or cerium, it has been found that the preferred precursor catalytic material for incorporation in tube manufacture is a cerium oxide catalyst precursor, namely hydrated cerium oxide. This material may be obtained from Advanced Material Resources of Toronto, Ontario, Canada. The inclusion of the hydrated form of cerium oxide in the ceramic precursor slurry results in its crystalline structure changing during the mild calcining process. The cerium oxide is dehydrated to become an alternative crystalline cerium oxide in the calcined material, normally in the formed of crystallites. During the conversion of the hydrated cerium oxide to cerium oxide catalyst it is thought that the developing cerium oxide catalyzes the oxidation, i.e., burning of the binder material, particularly when the binder is organic such as cellulosic material. It is though that the catalyzed oxidation of the binder material enhances the size of the pores being formed in the tubular element as it is calcined. By virtue of the presence of the catalytic cerium oxide, the extent of oxidizing of the cellulose material can be controlled to provide a desired pore size in the material to achieve the desired predetermined porosity in the tubular element.

Another advantage to the in situ incorporation of the cerium oxide catalyst in the tubular element is that an enhanced oxidation of invisible odor causing volatiles is achieved to thereby reduce any unpleasant odors emanating from the cigarette construction. It has been found that the invisible volatile components include ammonia and aldehydes. The in situ presence of the cerium oxide has surprisingly, even in the presence of high levels of carbon monoxide competing for oxidation sites on the catalyst, achieved oxidation of the ammonia and aldehyde constituents converting them into odorless constituents or at least constituents which have a more normal odor associated with cigarette smoking. It is particularly surprising in view of all of the chemicals of combustion from a burning cigarette, that the cerium oxide catalyst works particularly well in neutralizing the smell of ammonia in the invisible volatiles which permeate the porous tubular member.

Although the in situ formation of the cerium oxide catalyst in the tubular element is advantageous in not only catalyzing oxidation of the volatiles but as well providing an enhanced control on the porosity of the element, it is appreciated that the cerium oxide catalyst may be applied in sintered form as a powder to the interior of or exterior of the tubular element or within the openings of the tubular element or on the matting for openings in the tubular element, as previously described with respect to the other type of catalyst.

Various aspects of the several embodiments are exemplified as follows where such specific examples are not intended to be limiting the scope of the claims.

The cigarette for the device may range in size from about 3.5 mm to 10 mm and preferably about 4 to 8 mm in diameter. Very acceptable performance has been realized with cigarettes having diameters of about 4 to 5 mm. In order to provide the desired flavor and taste in the mainstream smoke, particularly with the thinner cigarettes, it is understood that the blend of the cigarette may be modified in accordance with the blending processes described in applicant's U.S. Pat. No. 5,524,647. The packing density of the cigarette, even with the thinner cigarettes does not have to be special. Normal packing densities may employed such as in the range of 200 to 300 $mg/cm^3$. The device provides the desired number of puffs for the thinner cigarette so that there is no need to use higher or lower than normal packing densities. The cigarette may be wrapped in any suitable cigarette paper of a porosity which may be greater than porosity of the tube. The paper porosity should range from 10 to 100 Coresta units and preferably 40 to 60 Coresta units. Vanillin and other flavor additives may be incorporated in the paper. The free-burn rate of the thin cigarettes in normal smoking conditions, i.e., outside of the tube, is quite high. For example, with a 5 mm diameter cigarette with normal blend, packing density and cigarette paper, the free burn rate is about 5 mm/minute. With the 4 mm diameter cigarette, the free burn rate is significantly greater, namely, 8 to 10 mm/minute. This is very high considering a normal 8 mm cigarette has a free-burn rate of about 3 mm/minute. Considering that use of the device converts a thin cigarette of normal length into an 8 to 10 puff cigarette is quite surprising while maintaining desired taste and flavor for the smoker.

The physical parameters of the tube which provide these features include a porosity value for the tube in the range of about 20 Coresta units up to about 60 Coresta units. When the device is assembled, the pressure drop for the unit may range from about 0.5 cm $H_2O$ column to 25 cm $H_2O$ column and preferably 3 to 14 cm $H_2O$ column and most preferably 5 to 10 cm $H_2O$ column. The interior diameter of the tube is about 7 to 10 mm with a tube wall thickness of about 0.25 mm to about 0.5 mm. The preferred cigarette diameters are about 4 or 5 mm to provide a gap spacing of about 0.5 mm to 3 mm, preferably about 1 to 2.5 mm and most preferably about 1.5 to 2.5 mm. During use with this range of gap spacing between cigarette and tube, the cigarette attains a temperature of about 600 to 800° C. during puff and about 400 to 600° C. during idle. The tube is at a considerably lower temperature in the range of about 120° to 200° C. The tube external temperature is preferably wrapped in normal cigarette paper having a porosity of 10 to 100 Coresta units and preferably 40 to 80 Coresta units where the porosity of the paper should be greater than that of the tube to ensure the paper does not interfere with tube porosity factor controlling free-burn rate. It has been found that if catalytic material, such as, cerium oxide is applied to the outside of the tube, the combustion of the paper is catalyzed so that there is greater paper discoloration at each puff to indicate clearly the location of the burning coal in the tube. With this range of porosities for the tube and paper where the porosity is somewhat uniform across the material, no visible sidestream smoke passes through the tube only invisible volatiles pass which can be treated in the presence of catalyst to convert the gases to odorless constituents.

The preferred cigarette filter construction of FIG. 24, has a very low pressure drop, usually one-half the pressure drop of a normal filter, namely in the range of about 1 to 3.

The preferred catalytic material is a mildly calcined hydrated form of cerium oxide ($Ce_2O_3 \times H_2O$) which is available from the aforementioned AMR of Toronto.

The catalyst may be incorporated into the sheet manufacture where a slurry composition of about 90 to 95% by weight water includes inorganic materials of glass fibers and microfibers, clay, talcs and the like and organic binders of acrylnitriles and acrylic based latex. In addition, to hold paper strength before calcining, the slurry may include cellulosic fiber. In the finished dried paper, the inorganics may comprises up to 90% by weight of the paper. The paper normally has a thickness of 5 to 10 mil and is wrapped upon itself 2 to 3 times in making the tube. The tube is mildly calcined by heat treating in an oxidizing atmosphere at a first phase temperature of about 220 to 260° C. and a second phase temperature of 400° C. to 600° C. This stagewise heating ensures a release of the volatiles without puffing the material. The catalyst may be incorporated on a dry sheet weight basis of about 0.5 to 10%. Preferably the catalyst precursor is incorporated at about 1 to 5% by weight and most preferably 1 to 3% by weight. With suitable organic loadings a desired porosity in the tube is achieved when the pore size is capable of restricting flow to control free-burn rate and contain the hot combustion gases in the tube. Preferred densities of the paper have a density of about 0.70 gm/cm$^3$ to 0.80 gm/cm$^3$ which is achieved with a higher organic loading in the slurry.

In a preferred embodiment of the invention the tubular element may have an exterior dimension the same as that of a conventional cigarette so that the overall appearance of the device with the tip in place is that of a conventional cigarette. By virtue of free-burn rate control, the thin non-conventional cigarette used within the device may have considerably less tobacco perhaps up to three quarters less tobacco, and in accordance with a preferred embodiment of the invention may have two-thirds less tobacco. The free-burn rate control ensures that the cigarette, during its idle period burns sufficiently slow that the usual number of puffs are obtained from the device of this invention corresponding to that obtained from a conventional cigarette. The significant reduction in the amount of tobacco used which would normally be waste in a conventional size cigarette, now provides a significant cost saving in cigarette manufacture while still realizing all of the other advantages and features of a conventional cigarette.

Preferred embodiments of the invention have been described herein. It is understood that variations may be made thereto without departing from the spirit of the invention or the scope of the appended claims.

What is claimed:

1. A device for treating cigarette smoke, the device comprising:

(a) non-combustible tubular element encasing an effective length of a tobacco charge of a cigarette located in said tubular element; and (b) the tubular element comprising a cerium oxide catalyst to convert odor causing ammonia and aldehydes in the cigarette smoke to odorless gases or gases with acceptable odor.

2. The device of claim 1 wherein the catalyst further comprises a precious metal.

3. A device for treating cigarette smoke, the device comprising:

(a) non-combustible tubular element encasing an effective length of a tobacco charge of a cigarette located in said tubular element; and (b) the tubular element comprising a cerium oxide catalyst, wherein the catalyst converts odor-causing ammonia and aldehydes in the cigarette smoke to odorless gases or gases with acceptable odor.

4. The device of claim 3 wherein the catalyst further comprises a precious metal.

* * * * *